United States Patent [19]

Noble

[11] Patent Number: 4,972,851

[45] Date of Patent: Nov. 27, 1990

[54] DIVERSIONAL AND THERAPEUTIC DEVICE FOR ORGANIC BRAIN SYNDROME PATIENTS

[76] Inventor: Rosemary G. Noble, 508 Blackbird Dr., Bear, Del. 19701

[21] Appl. No.: 306,786

[22] Filed: Feb. 6, 1989

[51] Int. Cl.[5] ..... A61B 19/00

[52] U.S. Cl. ..... 128/897; 128/898

[58] Field of Search ..... 600/26, 27; 128/745, 128/746, 25 R-26, 898, 897; 446/71-73, 75, 491; 272/67

[56] References Cited

U.S. PATENT DOCUMENTS 4,158,920 6/1979 Walker ..... 128/745

*Primary Examiner*—Randall L. Green
*Assistant Examiner*—K. M. Reichle
*Attorney, Agent, or Firm*—Robert Jacobs

[57] ABSTRACT

A method and device is described for the diversion, cognitive stimulation, maintenance of hand strength and dexterity, and hand-eye coordination of patients with organic brain syndromes or brain dysfunctional patients manifesting comparable symptoms. The device consists of a container with a closure that can withstand falls from about 1.5 to about 4 feet without opening or breaking any items within said container. The devices within said container include items that can be felt and rubbed by the patients to stimulate movement of the fingers and the sensory areas of the brain; items which can be squeezed again for finger dixterity and for diversion, i.e., entertainment of the patients so that they are maintained in a happy and busy frame of mind. Other items such as containers with removable covers, items which can be stretched, items that have reflective surfaces, materials that can be stacked, combs, and eating utensils are also included. All of these items are to allow the patients to have use of hands, fingers, and eyes so that they are not bored, and maintain fine motor coordination and dexterity.

7 Claims, 2 Drawing Sheets

DIVERSIONAL AND THERAPEUTIC DEVICE FOR ORGANIC BRAIN SYNDROME PATIENTS

GENERAL BACKGROUND

This invention is meant as a diversional and therapeutic device for individuals who suffer from organic brain syndrome, including Altzheimer's disease, Pick's disease, cerebrovascular accident or stroke, Creutzfeldt-Jakob disease, Huntington's chorea, Parkinson's disease. In addition, those patients who have, because of birth defects or trauma or other injury, manifested symptoms comparable to organic brain syndrome with respect to memory loss, loss of ability to maintain attention, and loss of ability to maintain rational contact with others and/or loss of ability to perform activities of daily living, such as bathing, dressing and self-feeding, can also benefit from this device.

FIELD OF USE

This invention is meant to be used in facilities whether private, public or in the home for patients who suffer from the aforementioned afflictions. It has been noted that these patients require intensive care both from family and staff. The care is necessary because of the patients' loss of ability to remain attentive to activities of daily living as well as their loss of ability to do simple tasks. For example the patients lose the ability to manipulate, i.e., to open and close objects by use of their hands, bathe, comb their hair, or feed themselves. This device occupies the patients and maintains the patients' skills.

SUMMARY OF THE INVENTION

It is the object of this invention to provide a device containing various stimulative and physical therapy objects for use by organic brain syndrome patients. It is another object to provide a device which can be placed and secured to a chair with an integral tray which helps secure the patient in the chair providing a work surface for the patient such as that which is sold under the trademark "GERI-CHAIR" or small table, or used on a bed table. It is another object to provide a device that can be opened without great difficulty by the patients but which, upon being closed and dropped, will not readily open nor shatter when falling from about a 1.5 foot to about 4.0 foot height. It is also an object to provide a method for the diversion and cognitive stimulation of the patients by providing objects within the container to interest the patients so as to lessen the amount of direct staff time utilized in patient diversion and activity. This method and/or device also has the potential beneficial effect of lowering the tendency of such patients to be bored with their environment, agitated and to wander. It is also an object to provide the patients with the means to maintain finger dexterity, hand-eye coordination, fine motor muscle tone, finger-thumb opposition, and thus maintain a method of continuing the skill of feeding themselves and fulfilling other activities of daily living, and reviewing the results of their work in reflective surfaces.

DETAILED DESCRIPTION OF THE PREFERRED EMBODIMENT

Figure 1:
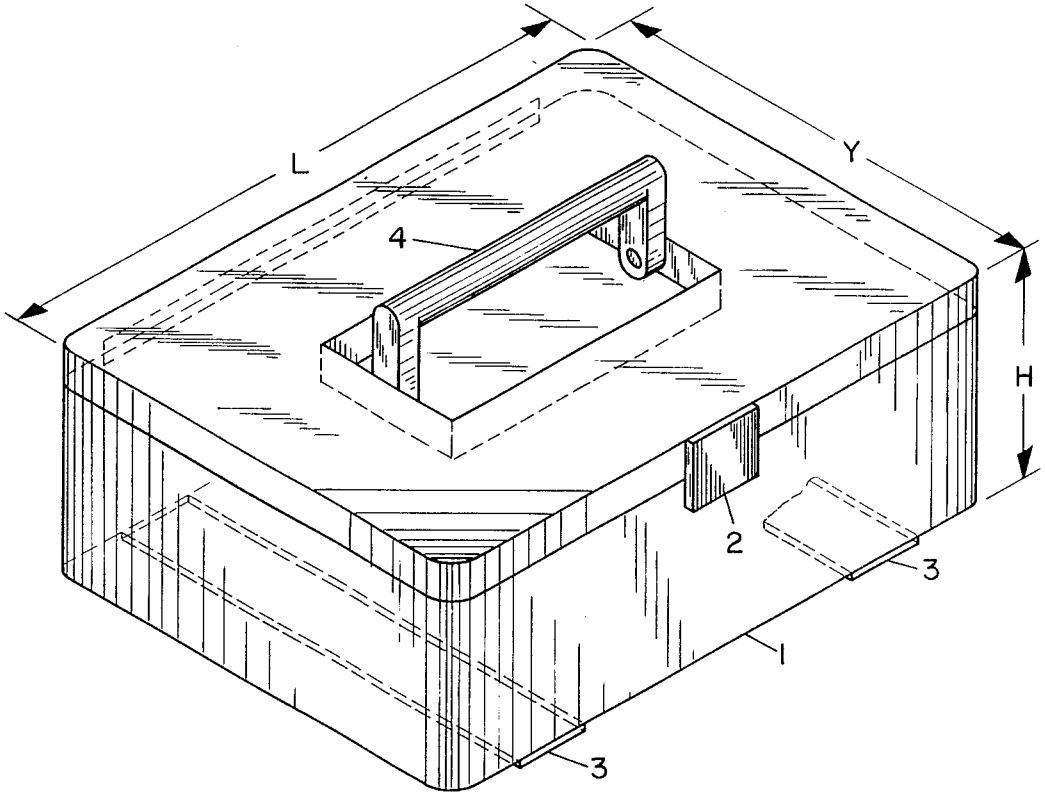
FIG. 1 is a perspective view of the container in the closed position.

The container in FIG. 1 is a drawing of the container in a closed condition. FIG. 1, Item 1, of this invention has rounded edges, a locking device, Item 2 on the cover or lid thereof, and a securing means, Item 3, on the bottom of said container which can adhere to a tray's surface so as to avoid movement. In addition, a handle, Item 4, is an integral part of the cover for ease of carrying. The size of the container in direction Y should be about 8.0 inches in order to snugly fit on the "GERI-CHAIR" tray or small table, but can be as small as 4.0 inches. Direction L may be anywhere from about 8 inches to about 16.0 inches and the height or depth, H, of the container should be maintained at about 3.0 inches to about 7.0 inches. Although a rectangular container is illustrated, oval or cylindrical containers can be utilized so long as the overall dimensions are close to those described and the bottom surface is flat. In the rectangular box the ratio of Y to L should be about 1 to 2. Items which can be placed in the container will include, among others, non-metallic eating utensils, pullable items, foldable items, reflective items, stretchable items, stackable items, and screwable items such as bottles and jars.

Figure 2:
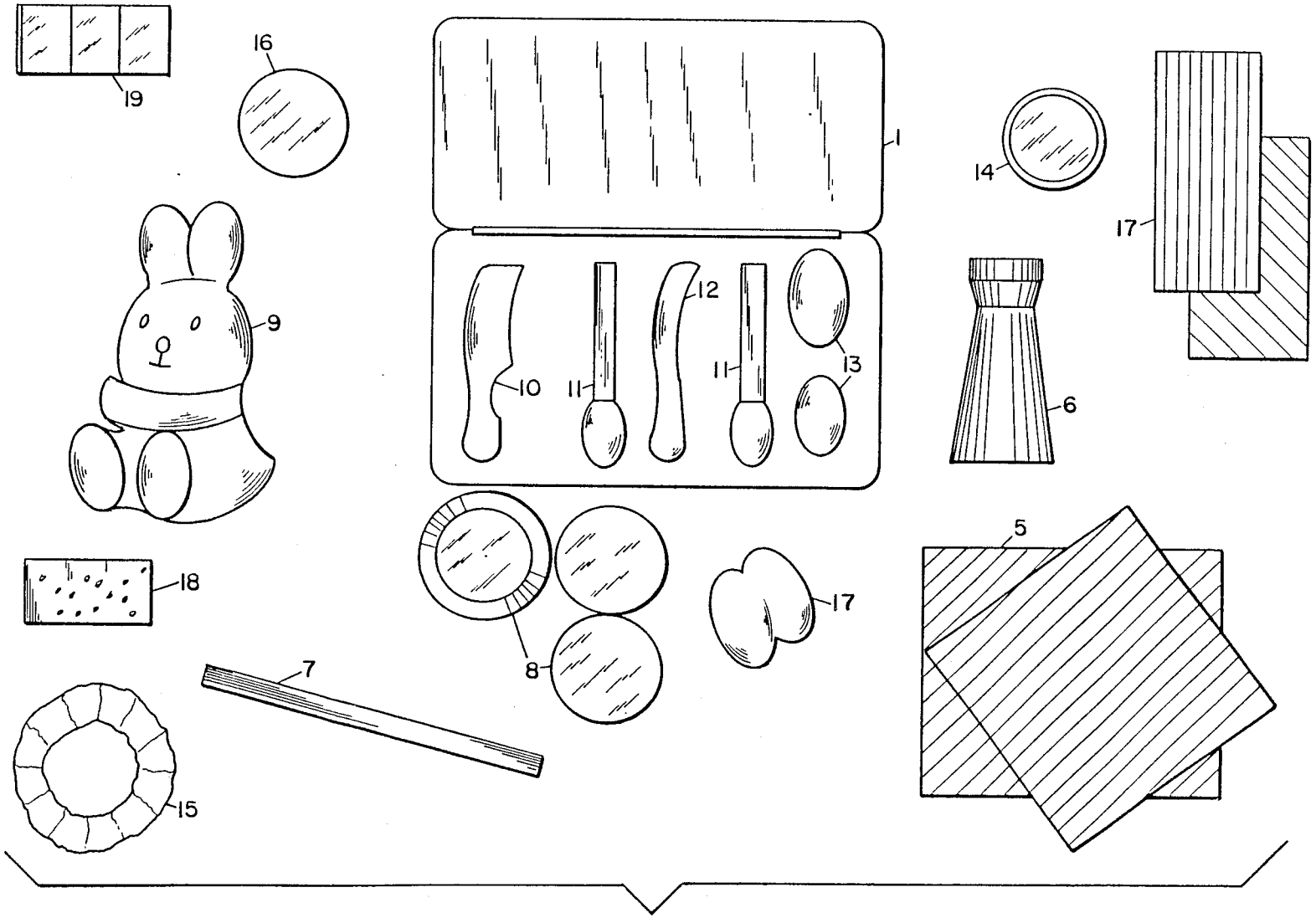
FIG. 2 is a perspective view of the container in the opened condition and the items carried thereby, some of which are inside and some of which are outside of the container, for clarity.

FIG. 2 is a representation of the container in its open position and the contents within and outside said container. In FIG. 2, Items 5 through 19 are shown for illustration purposes. The following are more detailed descriptions of the item and its therapeutic use.

Item 5. Pieces of foldable felt cloth which allow the patients both to get the sensation or feel when rubbed and finger dexterity in folding the cloth;

Item 6. Two squeezable plastic bottles wherein the caps are no less than about 2.5" diameter and the bottle is no less than about 2.5" in diameter and the height is from about 2 to about 6 inches. Item 6 is utilized for both the sensation of squeezing for finger dexterity, finger-thumb opposition and the ability to open the bottle by screwing off the caps and screwing them on, and is both entertaining for the patients as well as enabling them to maintain mental alertness and fine motor finger dexterity.

Item 7. A stretching material for manipulation;

Item 8. A plastic reflective mirror;

Item 9. A small stuffed toy animal;

Item 10. A standard comb with handle; Length at least about 4 inches, all of which of which are brightly colored;

Item 11. A colored plastic spoon;

Item 12. A plastic rounded knife;

Item 13. Oval or round soft plastic squeezable object in the shape of an egg;

Item 14. Stackable objects which nest and/or can be stacked;

Item 15. Circular, stretchable materials;

Item 16. A leather pouch;

Item 17. Pieces of material of various textures and colors;

Item 18. A sponge;

Item 19. A wallet including a hook and loop type fastener such as that which is sold under the trademark "VELCRO".

Although the specific items listed above are illustrative of those items which are to be contained within the shatterproof container, they fall into several categories. Thus foldable items include cloth, paper, plastic and leather sheets or strips; stretchable items such as cloth bands or elastic ropes or leather thongs; pullable items such as lengths of cloth or soft plastic toys; squeezable items such as stuffed animals, soft plastic bottles or plastic dishes; non-metallic utensils including eating utensils or grooming utensils; items which can be stacked within or upon each other such as cups, blocks or covers; items containing screwable members such as jars, bolts or bottles; and items with reflective surfaces such as mirrors. None of these items can have easily removable small attachments. Thus, small stuffed animals cannot have button eyes or easily removable body parts. It is preferred that the colored material be in forms of strips which are 8 to 12 inch squares or rectangles. All of the items from eating utensils to combs, sponges, and leather pouches are of varied bright colors and textured for hand feel.

All of these items should be made from soft materials which are not subject to breaking with no sharp edges such as cloth, paper, leather, soft plastic or nonbreakable rigid plastic. The items cannot be small and thus inspirable or able to be swallowed. Thus a dimension of at least about three inches in length and a half inch in width with a variable thickness is required. The reflective surface can be as little as one quarter inch in thickness but must also be at least 3 inches in the other dimensions, that is, width and length, or diameter.

In the preferred embodiment the containers would be translucent to arouse the interest of the patient. They would contain from about ten to about twenty objects for diversion and cognitive stimulation. The preferred means of securing the container to trays would be slip proof rubber pads and the handle would fold into a recess in the top of the container.

The therapeutic device provides the patients with a challenge in both the opening and utilization of the materials as well as having their own individual case so that they can use it at their leisure. The items listed above are only demonstrative as the basic concept of the invention is to have sufficient items within to keep the patient's interest. Therefore the items must contain materials which have different textures for the touch; different colors for eye appeal; different stiffness and stretch ability to promote finger manipulation and still stimulate the patients. The case must have items which can be squeezed and opened, again for stimulation. In addition for maintaining hand-eye coordination the device must contain items which can be stretched for both the feel of stretching in addition to the utilization of arm, wrist and finger muscles in stretching to maintain muscle strength. Plastic or other non-breakable mirrored surfaces would be included to allow the patients to look at themselves as well as to encourage them to keep in touch with reality with respect to their being. Combs would be included to encourage the patients both to comb their own hair for hygiene and to encourage self-grooming. Stuffed toys would help maintain their attention span and would serve for tactile stimulation. Feeding utensils are included both to entertain as well as to maintain the patient's understanding of the utilization of the instruments so that the patients can be kept as independent as possible in feeding themselves for as long as possible.

This invention is not only therapeutic with respect to maintaining muscle tone, mental alertness, and the everyday activities of daily living, but is also extremely important because the device has been found in experiments to maintain the patients' interest over long periods of time. This ability of the invention to maintain the interest of the patient has the additional salutory and important effect of freeing the staff of an institution or family in a home situation to go about other chores rather than giving constant direct attention to the patient.

Having thus described my invention I claim:

1. A method of treatment for a patient afflicted with organic brain syndrome or the like who suffers from memory loss, loss of ability to maintain attention, loss of ability to maintain rational contact with others and/or loss of ability to perform activities of daily living which comprises the steps of:

(A) providing the patient with a hand-manipulable device, said device comprising a shatter-proof container with rounded corners and a lid having locking means to releasably hold said lid in a closed position, and a multiplicity of means, stored within said container, for hand-manipulation by the patient while preventing inhalation or swallowing thereof by the patient, and (B) arousing the interest of the patient with said container causing the patient to open the container, remove said manipulation means held therewithin, and hand-manipulate said manipulation means thereby creating a diversion for the patient so that the patient is maintained in a happy and busy frame of mind lessening the amount of time care personnel utilized in patient diversion and activity, providing cognitive stimulation, maintaining hand strength and dexterity and hand-eye coordination and/or encouraging the continuance of activities of daily living and review of the end results of such activities.

2. A device for treating a patient afflicted with organic brain syndrome or the like who suffers from memory loss, loss of ability to maintain attention, loss of ability to maintain rational contact with others and/or loss of ability to perform activities of daily living comprising:

means for hand-manipulation by the patient to create a diversion for the patient so that the patient is maintained in a happy and busy frame of mind, lessening the amount of time care personnel utilize in patient diversion and activity, to provide cognitive stimulation, to maintain hand strength and dexterity, and hand-eye coordination and/or to encourage maintenance of daily functions including eating and combing of hair yet preventing inhalation and swallowing thereof, and container means for holding the manipulation means while remaining unbreakable and shatter-proof when dropped from a height of up to 4 feet above the ground and providing said treatment in combination with said hand-manipulation means, said container means including means for securement to small table surfaces and means for enabling carrying thereof.

3. A device as claimed in claim 2 wherein said hand-manipulation means includes pieces of foldable cloth, plastic bottles with screw caps, pieces of stretchable material, a plastic mirror, a stuffed animal, a comb with a handle, a soft squeezable object, stackable objects, leather objects, sponges and objects which include hook and loop type fasteners.

4. A device as claimed in claim 2 where said hand-manipulation means are formed of colored, non-metallic material.

5. A device as claimed in claim 2 wherein said container means is a rectangular box having a width ranging from 8 to 16 inches, a depth ranging from 3 to 7 inches and a length of about 8 inches.

6. A device as claimed in claim 2 where said hand-manipulation means have a length of at least 3 inches and a width of at least one-half inch.

7. A device as claimed in claim 2 wherein said hand-manipulation means have a diameter of at least three inches.

* * * * *